United States Patent [19]

Yasur

[11] 4,151,910

[45] May 1, 1979

[54] DUAL PURPOSE CONTAINER

[76] Inventor: Zion Yasur, Doar Na Shimshon, Moshav Tarom 2, Israel

[21] Appl. No.: 870,683

[22] Filed: Jan. 19, 1978

[30] Foreign Application Priority Data

Mar. 3, 1977 [IL] Israel ..... 51585

[51] Int. Cl.[2] ..... B65D 25/10

[52] U.S. Cl. ..... 206/216; 220/69; 220/93; 221/102; 206/540

[58] Field of Search ..... 220/93, 23.83, 23.86, 220/130, 386, 23, 69; 221/101, 102; 206/216, 540

[56] References Cited

U.S. PATENT DOCUMENTS

| | | | |
|---|---|---|---|
| 1,207,988 | 12/1916 | Olmsted | 220/22.1 X |
| 1,272,965 | 7/1918 | Kartzmark | 221/102 X |
| 2,008,104 | 7/1935 | Juvinall | 220/336 X |
| 2,182,615 | 12/1939 | Johnson | 221/102 X |
| 3,526,335 | 9/1970 | Swett et al. | 220/23.83 X |

FOREIGN PATENT DOCUMENTS

| | | | |
|---|---|---|---|
| 748348 | 7/1933 | France | 220/345 |
| 1216458 | 4/1960 | France | 220/93 |
| 485033 | 9/1953 | Italy | 220/93 |

*Primary Examiner*—William Price
*Assistant Examiner*—Joseph M. Moy
*Attorney, Agent, or Firm*—Allison C. Collard; Thomas M. Galgano

[57] ABSTRACT

The invention provides a dual purpose container and dispenser especially adapted for comestible products encased in disposable waste material such as edible nuts and seeds having shells and wrapped candies. The dual purpose container and dispenser includes a housing adapted to contain the comestible products and a divider movable within the housing and adapted to divide the housing into two separate compartments. The housing is provided with at least two openings, the first of which openings is in communication with one compartment and is adapted for dispensing comestible products contained therein and the second of which openings is in communication with the other compartment and is adapted for the insertion of disposable waste material into the other compartment; the arrangement being such that upon the emptying of the compartment containing the comestible products, the other compartment is adapted to increase in volume as a result of the movement of the divider to accommodate additional waste material.

11 Claims, 3 Drawing Figures

DUAL PURPOSE CONTAINER

The present invention relates to a dual purpose container and dispenser. More particularly the present invention relates to a dual purpose container especially adapted for comestible products encased in disposable waste material such as edible nuts and seeds having shells such as peanuts, almonds and sunflower seeds and individually wrapped candies such as taffies and the like.

As is known one of the major problems facing vendors and consumers of comestible products encased in disposable waste material is the problem of the dirtying and littering of places where such products are consumed.

Thus not only do esthetic and environmental considerations dictate that a solution be found to the littering and dirtying of public streets, playgrounds and parks but economical considerations also demand that an acceptable solution be found to the problem which results in the outlay of huge sums of money and the expenditure of many man-power hours in the cleaning of buses, movie theaters and especially sport stadiums and arenas from the disposable waste material which accumulates as a result of the vending and consumption of the type of comestible products described above.

So great is the problem of cleaning up such disposable waste products in the face of today's rising costs, that many owners of public places of entertainment, such as movie theaters, have banned the sale of such products in their premises and especially the sale of edible nuts and seeds having shells, because of the extreme difficulty encountered in cleaning and removing the multitude of small and often wet shell pieces dispersed over the area where such products have been consumed.

Of course, this is not a satisfactory solution since on the one hand such a drastic step encroaches on the livelihood of the vendors of such products and on the other hand this ban does not deter compulsive and habitual consumers of such products from bringing them with them anyway to enhance their enjoyment of the entertainment which they are watching.

It is therefor an object of the present invention to solve this long-outstanding and serious problem and to provide a means enabling the sale of said comestible products in general and in theaters and stadiums in particular without the heretofor attendant problem of littered waste material therefrom.

This and other objects which will be apparent from the specification and claims is accomplished in accordance with the present invention which is directed to and provides a dual purpose container and dispenser, especially adapted for comestible products encased in disposable waste material, comprising a housing adapted to contain said comestible products and a divider movable within said housing and adapted to divide said housing into two separate compartments wherein said housing is provided with at least two openings, the first of which openings is in communication with one compartment and is adapted for dispensing comestible products contained therein and the second of which openings is in communication with the other compartment and adapted for the insertion of said disposable waste material into said other compartment the arrangement being such that upon the emptying of the compartment containing said comestible products said other compartment is adapted to increase in volume as a result of the movement of said divider to accomodate additional waste material.

As will be described more fully hereinafter in the preferred embodiments of the present invention said housing is preferably substantially tubular in shape and open at at least one of its ends. Especially preferred are such housings wherein at least one of said open ends is provided with a removable lid adapted to close said open end. Also preferred are containers wherein said first product dispensing opening is adapted to be opened and closed by means of a closure provided therefor.

While the invention will now be described in connection with certain preferred embodiments with reference to the following illustrative figures, so that it may be more fully understood, it is stressed that the particulars shown and described are by way of example and for purposes of illustrative discussion only and are presented in the cause of providing what is believed to be the most useful and readily understood description of the principles and conceptual aspects of the invention. In this regard no attempt is made to show structural details of the containers and their parts in more detail than is necessary for a fundamental understanding of the invention, the description taken with the drawings making apparent to those skilled in the art how the several forms of the invention may be embodied in practice.

Figure 1:
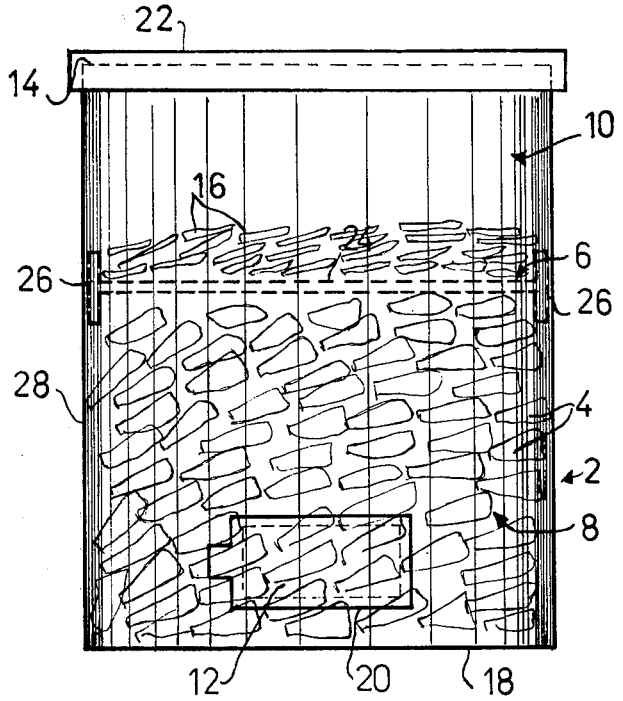
FIG. 1 is an isometric view of one embodiment of a container according to the present invention.

Referring first to FIG. 1 there is illustrated one possible embodiment of a dual purpose container and dispenser especially adapted for comestible products encased in disposable waste material according to the present invention comprising a housing 2 adapted to contain said comestible products 4 and a divider 6 movable within said housing and adapted to divide said housing into two separate compartments 8, 10 wherein said housing is provided with at least two openings, 12, 14 the first of which openings 12 is in communication with one compartment 8 and is adapted for dispensing comestible products 4 contained therein and the second of which openings 14 is in communication with the other compartment 10 and adapted for the insertion of said disposable waste material 16 into said other compartment 10 the arrangement being such that upon the emptying of the compartment 8 containing said comestible products 4 said other compartment 10 is adapted to increase in volume to accomodate additional waste material 16 as a result of the movement of said divider 6.

In the embodiment shown the housing is preferably made of an at least semi-rigid synthetic material such as plastic and is a tubular housing preferably substantially of cylindrical shape as shown having an integral bottom 18.

Of course in countries where paper and cardboard products are less expensive than plastic it is possible to make the container from them or reinforced cardboard and then a housing of square or rectangular cross-section and a bottom, if provided, formed from folded flaps of cardboard depending from the sides of the housing would be preferred.

Returning now to FIG. 1 in the preferred embodiment shown said first product dispensing opening 12 is preferably made in the lower portion of the wall of said housing 2 and said second waste receiving opening is constituted by an open top end 14 of said housing.

As will be realized, however, said first product dispensing opening could similarly be made in the bottom 18 of said housing and still fulfill its dispensing function.

Irrespective of the position of said first dispensing opening it is preferred that said first product dispensing opening be adapted to be opened and closed by means of a closure provided therefor.

In the embodiment shown said closure is a hinged closure 20 which is a simple flap adapted to be pulled open to allow the dispensing of the comestible product 4 and wedged shut into said opening 12 when said product is not to be dispensed.

Similarly said open top end 14 of said housing is preferably provided with a removable lid 22 adapted to close said open end 14 in order to retain the waste material 16 inserted therein. As shown, said divider 6 can preferably be a plate-like element 24 provided on its periphery with at least one depending flange 26 extending substantially normal to said plate wherein the periphery of said plate is adapted to abut the inner surface 28 of said housing 2. Furthermore while not fully visible in the isometric view shown said flange 26 preferably will extend along the entire periphery of said plate 24 on both sides thereof, as shown, to assure that the divider 6 will not tip over and will retain its orientation in the housing even when said divider 6 moves.

It will also be noted that while other more complicated systems are possible it is preferred that said divider 6 be adapted to freely move in said housing as a result of the force of gravity.

From the above description and reference to the figure the use of the container according to the present invention as described hereinafter can readily be understood. Thus according to the present invention it is possible and envisioned that a consumer receives a container according to the present invention wherein the bottom compartment is filled with comestible products 4 and the upper compartment 10 is empty. While divider 6 is sufficient to assure the protection of the comestible products 4 from contamination from dirt, rain, etc. lid 22 provides an extra measure of sealing and protection therefor.

The consumer opens closure 20 to reveal opening 12 and to dispense the product 4 and also removes lid 22, which can optionally be adapted for temporary storage affixed to the bottom 10 of the container to create access to the wide mouthed opening 14 of compartment 10 for which compartment divider 6 acts as a bottom.

As the comestible product 4 is consumed the waste material 16 is inserted into convenient and readily accessible compartment 10. Furthermore as the product is consumed and the volume which it occupies in compartment 8 is reduced, divider 6 descends under the influence of gravity and compartment 10 increases in volume to accomodate the additional waste material being produced by the consumption of the comestible product.

When the comestible product is finished, the lid 22 is then simply reinserted on open end 14 and the waste material enclosed in said container is then easily and neatly disposed of.

Figure 2:
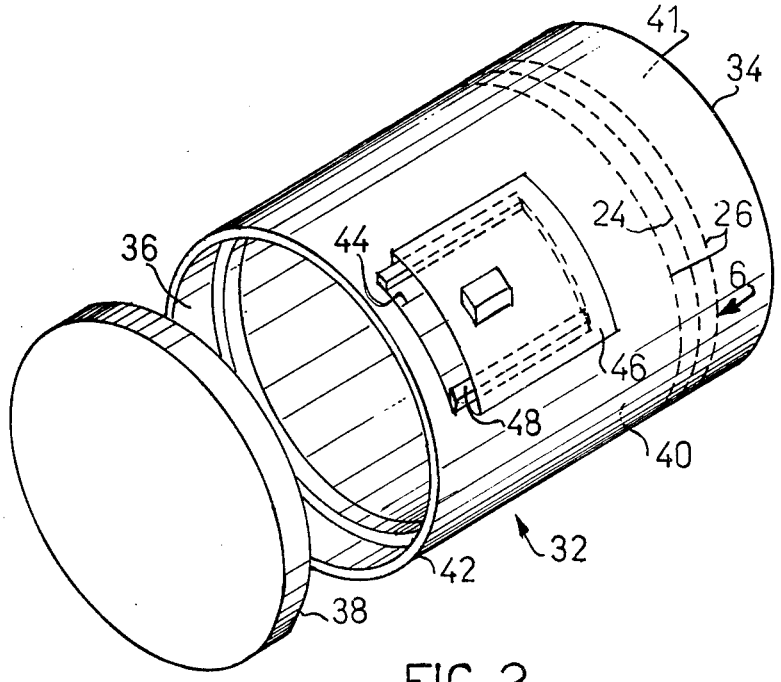
FIG. 2 is an isometric view of a different preferred embodiment of a container according to the present invention.

Referring now to FIG. 2 there is illustrated yet another embodiment of the present invention wherein the container comprises a housing 32 which housing 32 is open at both of its ends 34, 36 and provided with a removable lid 38 at its bottom end 36 adapted to assure the retention of the comestible products contained in the bottom compartment 40 until said products are dispensed and which is then further adapted to be removed from said bottom 36 and to close the open upper end 34 of said housing to retain the waste material inserted therein.

In such an embodiment said housing 32 is preferably provided with at least one projection 42 along the inner surface of the wall in the lower portion of said housing which projection 42 is adapted to arrest and stop the movement of the divider 6 and thereby form a retaining bottom in combination with said divider 6 for the waste material compartment 41 upon the emptying of the product dispensing compartment 40 and the removal of the bottom end 38 therefrom. Preferably said projection 42 will be an inner peripheral bead formed along said inner surface as shown, although other arrangements are also possible.

While various closures for the first dispensing opening are possible, in this embodiment there is provided as illustrated a sliding closure 46 which could be made of hard polyethylene or a similar material and which is adapted to open or close opening 44 by sliding arrangement with rails 48.

This type of bottomless container having only a removable lid 38 is especially preferred because of its lower manufacturing expense and is intended especially for the vending in stadiums and theaters of small amounts, e.g., 50 or 100 gm. amounts, of products which will be finished in one sitting and which containers will then be thrown away with the waste material enclosed therein.

Figure 3:
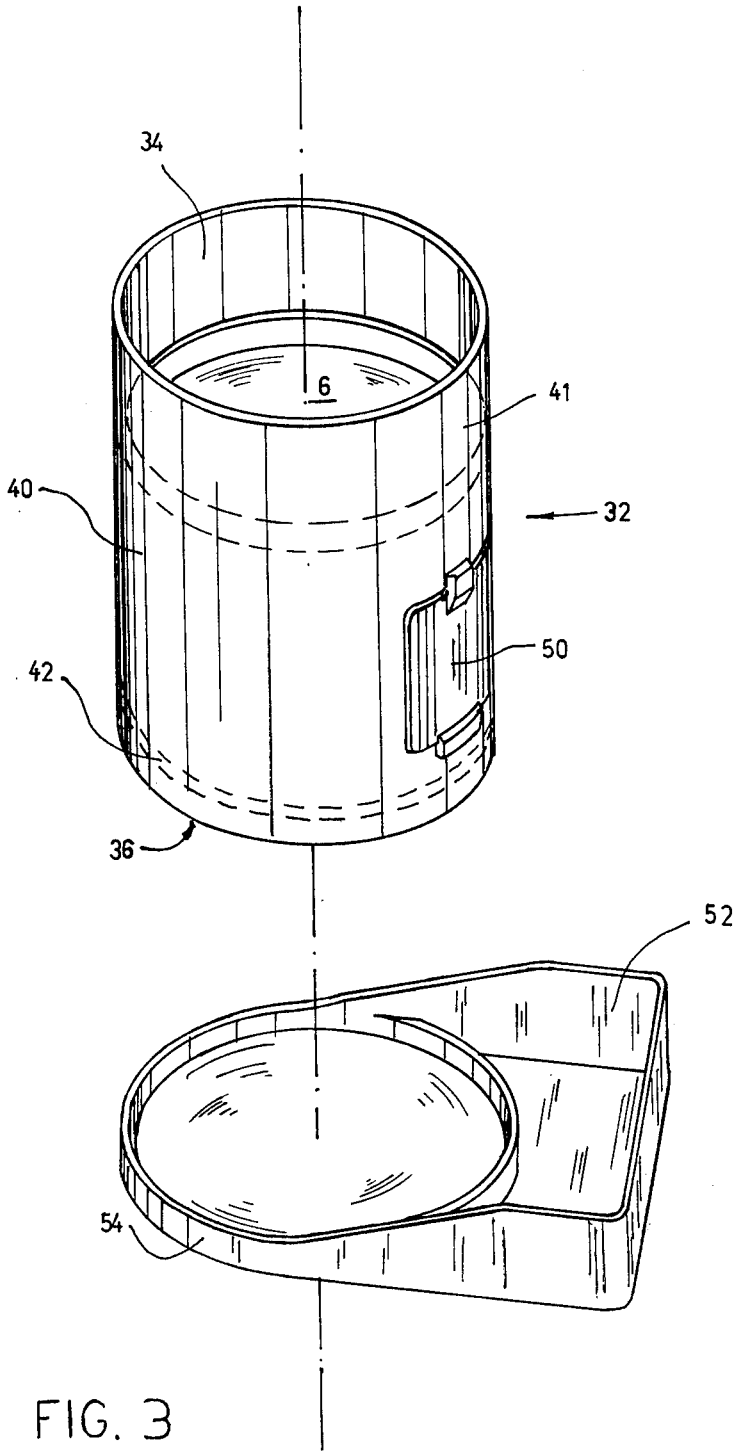
FIG. 3 is an isometric view of an especially preferred varient of the embodiment of FIG. 2.

Referring now to FIG. 3 which relates to an especially preferred varient of the embodiment illustrated in FIG. 2 and in which like numerals have been used to indicate like parts it can be seen that the container 32 instead of being provided with the more expensive sliding closure 46 of FIG. 2 is instead provided with a simple flap 50 adapted to be pulled open to allow the dispensing of the comestible product into a receiving tray-like extension 52 of removable bottom lid 54.

As will be realized the main advantage of this embodiment resides in the fact that the user need not dispense the comestible products into his hand and instead dispenses them into the receiving area of the tray-like extension 52 of the lid 54 from which he then readily takes said products for consumption as convenient.

While particular embodiments of the invention have been described and shown with reference to the figures said embodiments are to be considered in all respects as illustrative and not restrictive, the scope of the invention being indicated by the appended claims rather than by the foregoing description and all changes which come within the meaning and range of equivalency of the claims are therefor intended to be embraced therein.

What is claimed is:

1. A dual purpose container and dispenser containing comestible products encased in disposable waste material, comprising a housing and a divider movable within said housing and dividing said housing into two separate compartments wherein said housing is provided with at least two openings, the first of which openings is in communication with one compartment and is for dispensing said comestible products contained therein and the second of which openings is in communication with the other compartment and is for the insertion of said disposable waste material into said other compartment, the arrangement being such that upon the emptying of the compartment containing said comestible products said other compartment is adapted to increase in volume as a result of the movement of said divider to accomodate additional said waste material and wherein said first product dispensing opening is made in the lower portion of a side wall of said housing and said second waste receiving opening is constituted by an open top end of said housing said housing being open at both of its ends and provided with a removable lid at its bottom end to assure the retention of the comestible products contained in the bottom compartment until said products are dispensed, said side wall including means to retain said divider when all said comestible products are dispensed, and said lid is then to be removed from said bottom and to close the open upper end of said housing to retain the waste material inserted therein, said lid being provided with a tray-like extension to receive said comestible products dispensed from said first product dispensing opening.

2. A dual purpose container as claimed in claim 1 wherein said first product dispensing opening is adapted to be opened and closed by means of a closure provided therefor.

3. A dual purpose container as claimed in claim 2 wherein said closure is a sliding closure.

4. A dual purpose container as claimed in claim 2 wherein said closure is a hinged closure.

5. A dual purpose container as claimed in claim 1 wherein said divider is adapted to freely move in said housing as a result of the force of gravity.

6. A dual purpose container as claimed in claim 1 wherein said divider is a plate-like element provided on its periphery with at least one depending flange extending substantially normal to said plate like element and wherein the periphery of said plate like element is adapted to abut the inner surface of said housing.

7. A dual purpose container as claimed in claim 6 wherein said flange extends along the entire periphery of said plate like element on both sides thereof.

8. A dual purpose container as claimed in claim 1 wherein said housing is provided with at least one projection along the inner surface of said side wall in the lower portion of said housing which projection is adapted to stop the movement of said divider and thereby form a retaining bottom in combination with said divider for the waste material compartment.

9. A dual purpose container as claimed in claim 8 wherein said projection is an inner peripheral bead formed along said inner surface.

10. A dual purpose container as claimed in claim 1 wherein said housing is substantially cylindrical in shape.

11. A dual purpose container as claimed in claim 1 wherein said housing is made of an at least semi-rigid synthetic material.

* * * * *